US011047267B2

(12) United States Patent
Methley et al.

(10) Patent No.: US 11,047,267 B2
(45) Date of Patent: Jun. 29, 2021

(54) VARIABLE VALVE LIFT SYSTEM

(71) Applicant: Mechadyne International Ltd., Oxfordshire (GB)

(72) Inventors: Ian Methley, Witney (GB); Timothy Mark Lancefield, Shipston on Stour (GB); Kyle Webb, Abingdon (GB)

(73) Assignee: Mechadyne International Ltd., Oxfordshire (GB)

( * ) Notice: Subject to any disclaimer, the term of this patent is extended or adjusted under 35 U.S.C. 154(b) by 0 days.

(21) Appl. No.: 16/823,568

(22) Filed: Mar. 19, 2020

(65) Prior Publication Data

US 2020/0340373 A1 Oct. 29, 2020

(30) Foreign Application Priority Data

Apr. 25, 2019 (EP) ..... 19171064

(51) Int. Cl.
*F01L 1/18* (2006.01)
*F01L 13/00* (2006.01)
(Continued)

(52) U.S. Cl.
CPC ..... *F01L 1/181* (2013.01); *F01L 13/0047* (2013.01); *F01L 1/053* (2013.01); *F01L 1/22* (2013.01);
(Continued)

(58) Field of Classification Search
CPC ... F01L 2001/0473; F01L 1/053; F01L 1/181; F01L 2001/186; F01L 1/22; F01L 13/0047; F01L 2301/00
(Continued)

(56) References Cited

U.S. PATENT DOCUMENTS

2006/0112914 A1* 6/2006 Lancefield ..... F01L 1/267 123/90.4
2007/0074689 A1* 4/2007 Methley ..... F01L 1/146 123/90.16

FOREIGN PATENT DOCUMENTS

EP 1426569 A1 6/2004
GB 2438628 A 12/2007

OTHER PUBLICATIONS

Extended European Search Report; The Hague; dated Sep. 15, 2020.

* cited by examiner

*Primary Examiner* — Jorge L Leon, Jr.
(74) *Attorney, Agent, or Firm* — Patshegen IP LLC; Moshe Pinchas

(57) ABSTRACT

A summation rocker system is disclosed for acting on the end of a stem of a poppet valve (16) in dependence upon the combined lifts of a first and a second cam profile defined by different cam lobes (14, 22) of a concentric camshaft (46). The system comprises a first rocker (12) mounted on a pivot shaft (18) and having a first follower (44) to contact the first cam profile and an end acting on the valve (16) to displace the valve (16) by an amount dependent upon the lift of the first cam profile, a rocker shaft (24) to be fixedly mounted on the engine, and a second rocker (20) pivotable about the rocker shaft (24), the second rocker (20) having a second follower (48) to contact the second cam profile and acting to displace the pivot shaft (18) of the first rocker (12) in dependence of the lift of second cam profile. The rocker shaft (24) intersects a plane containing the axis of the pivot shaft (18) and the end of the first rocker (12) acting on the valve stem, and the first rocker (12) includes a cut-out (26) for receiving the rocker shaft (24), which cut-out (26) is configured and dimensioned to prevent the rocker shaft (24) from interfering with movement of the first rocker (12).

11 Claims, 4 Drawing Sheets

(51) Int. Cl.

| | |
|---|---|
| *F01L 1/26* | (2006.01) |
| *F01L 1/047* | (2006.01) |
| *F01L 1/053* | (2006.01) |
| *F01L 1/22* | (2006.01) |

(52) U.S. Cl.
CPC ..... *F01L 1/26* (2013.01); *F01L 2001/0473* (2013.01); *F01L 2001/186* (2013.01); *F01L 2301/00* (2020.05)

(58) Field of Classification Search
USPC ..... 123/90.2, 90.27, 90.39, 90.4, 90.44
See application file for complete search history.

VARIABLE VALVE LIFT SYSTEM

FIELD OF THE INVENTION

The invention relates to a valvetrain system for an internal combustion engine, and in particular to a system providing variable valve lift.

BACKGROUND

Traditionally, internal combustion engines use a single cam profile to enable gases to enter or exit the combustion chamber. More modern engines are able vary the valve lift profile depending on multiple factors, such as engine speed and load, to enable greater efficiency. A variable valve lift system utilising a summation rocker system may be used to combine two different cam profiles to produce the desired valve lift profile. The valve lift profile can be modified to suit prevailing engine operating conditions by changing the timing of the two cam profiles relative to each other.

Summation rocker systems are known from prior art, the one believed to be closest to the present invention being described in EP1426569. They function using two rockers, each acted upon by a respective one of two cam profiles. The two rockers are connected using a pivot shaft allowing the rockers to rotate relative to each other.

A first of the two rockers pivots about the pivot shaft and acts between a first cam profile and the stem of a poppet valve, to open and close the valve. The second of the two rockers is mounted in the engine on a fixed rocker shaft and acts between the second cam profile and the pivot shaft of the first rocker. This raises and lowers the pivot shaft supporting the first rocker in accordance with the profile of the second cam profile. The movement of the pivot shaft changes the position of the first rocker, thereby changing the valve lift. It follows that the valve lift at any point is determined by a combination of both the first and second cam profiles. In each case, a cam profile may be defined by a single cam lobe or, to avoid unbalanced forces, by two identical but axially spaced lobes.

For optimum performance, the two rockers should have the same mechanical advantage and the forces applied to the rockers should act to exert only a torque to cause the rocker to rotate about the pivot shaft or the rocker shaft, as the case may be. A further consideration in designing the geometry of the valvetrain is that the space available in the engine to accommodate it may be limited. As these different considerations create conflicting demands, it has hitherto been necessary to compromise and settle for a configuration that is less than optimal in terms of motion geometry and valvetrain packaging.

OBJECT OF THE INVENTION

The present invention therefore seeks to provide a valvetrain that employs cam summation but offers greater freedom in the relative positioning of the different components of the valvetrain.

SUMMARY OF THE INVENTION

According to the present invention, there is provided a variable valve lift system as hereinafter set forth in claim 1 of the appended claims.

Preferred features of the invention are set out in the appended dependent claims.

BRIEF DESCRIPTION OF THE DRAWINGS

The invention will now be described further, by way of example, with reference to the accompanying drawings, in which.

DETAILED DESCRIPTION OF EMBODIMENTS

Figure 1A:
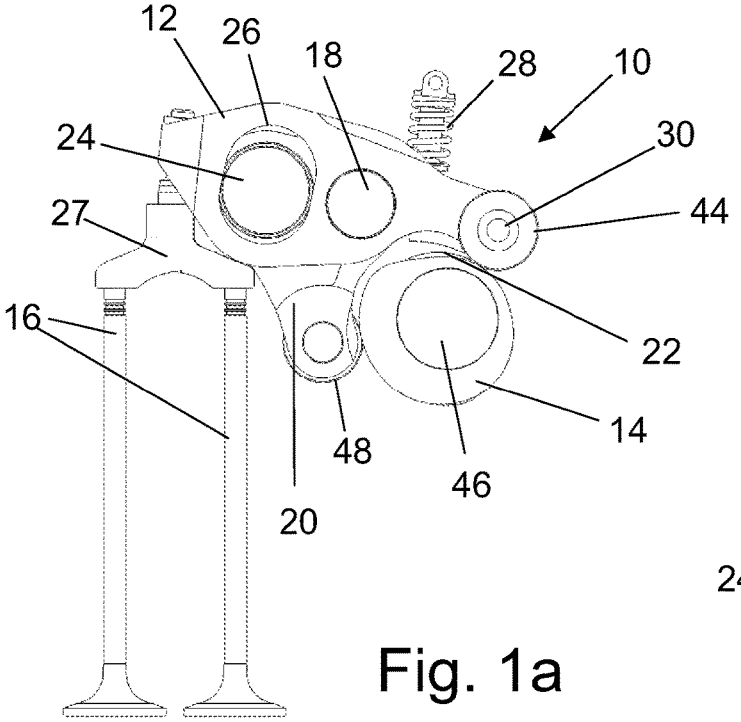
FIG. 1*a* is a front view of a first embodiment of a variable valve lift system, wherein a cut-out, in the form of a hole is provided in a first rocker for a rocker shaft.

In the description below of embodiments of the invention, in order to avoid unnecessary repetition, like parts of different embodiments have been allocated reference numerals with the same last two digits. Hence numerals XX, 1XX, 2XX, 3XX etc. will be to designate identical components, or possibly modified components fulfilling the same function.

FIG. 1*a* illustrates a summation rocker system 10 for acting on two poppet valves 16 in dependence upon the combined lifts of first and second cam profiles defined by different cam lobes 14, 22 of a concentric camshaft 46. A first rocker 12 of the system 10 is mounted about a pivot shaft 18 and has a first cam follower 44, in the form of a roller, in contact with the profile of the first cam lobe 14, The other end of the first rocker 12 acts on the valve stem via a bridge piece 27 to displace the valves 16 in dependence upon the lift of the profile of the first cam 14. A second rocker 20 is pivotable about a rocker shaft 24 which is fixedly mounted to an engine, the second rocker 20 having a second follower 48, again in the form of a roller, in contact with the profile of the second cam 22 (more clearly seen in FIG. 2). The second rocker 20 acts to displace the pivot shaft 18 of the first rocker 12 in dependence of the lift of the profile of the second cam 22.

As can be seen from FIG. 1*a*, the rocker shaft 24 intersects a plane that passes through the axis of the pivot shaft 18 and the end of the first rocker 12 applying a downward force (as viewed) to the valves 16. Such positioning of the rocker shaft 24, while enabling the geometry and packaging of the valvetrain to be optimised, would not be possible conventionally because a solid first rocker 12 and the rocker shaft 24 would be competing to occupy the same space.

Figure 1B:
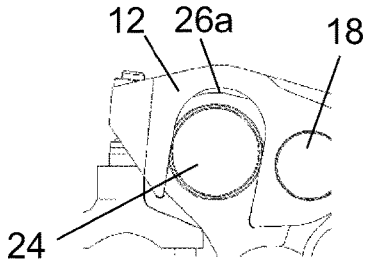
FIG. 1*b* shows a detail of an alternative design of the rocker in FIG. 1*a* in which the cut-out is in the form of a slot that extends to a boundary of the first rocker.

To accommodate the rocker shaft 24 in such a position, the first rocker 12 of the embodiments of the invention shown in FIGS. 1*a* and 1*b* is provided with a cut-out 26 configured and dimensioned to prevent the rocker shaft 24 from interfering with movement of the first rocker 12. In the case of FIG. 1*a*, the cut-out 26 is in the form of a hole within which the rocker shaft 24 is received with clearance, while in FIG. 1*b* the cut-out 26*a* is a slot that extends to the boundary of the first rocker 12.

While a circular hole of sufficiently large diameter may be used, it is preferred to minimise the amount of material removed from the first rocker by providing a hole that is elongated in the direction of relative movement. The direction of relative movement may be curved or relatively straight, depending on the geometry of the valvetrain.

Figure 3A:
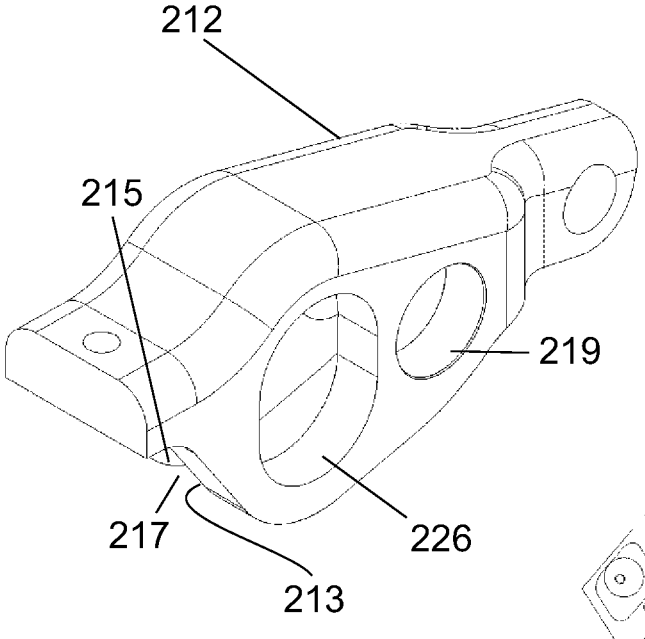
FIGS. 3*a* and 3*b* are different views of the first rocker of a third embodiment of the variable valve lift system, wherein the first rocker is manufactured of a single formed piece of sheet metal.
Figure 3B:
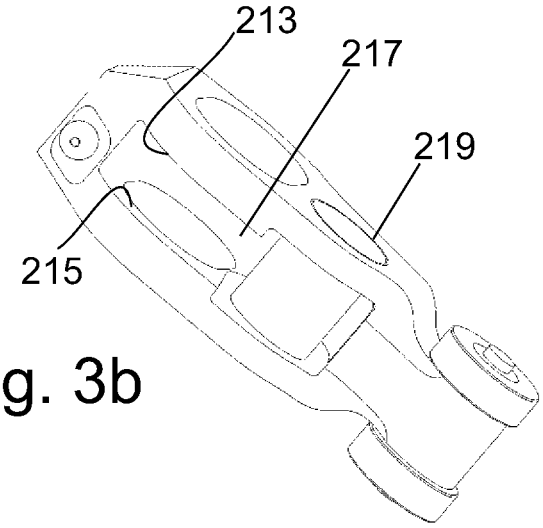

The first rocker 212, of the embodiment shown in FIGS. 3*a* and 3*b*, comprises two inner surfaces 213, 215 axially straddling the second rocker 20, the two surfaces 213, 215 defining between them a pocket 217 within which the second rocker 20 is received with clearance. The pivot shaft 18, which is received in aligned holes 219 in the surfaces 213 and 215 of the first rocker 12 is pivotably connected to the second rocker 20 within the pocket 217.

A control spring 28, shown in FIG. 1*a*, is used in order to maintain contact between the first follower 44 and its corresponding cam lobe 14 throughout its rotation. The control spring 28 acts on the first rocker 12 and is mounted to a fixed point on the engine.

The optimum position of the control spring 28 creates a force vector through the pivot shaft 18 perpendicular to a line created between the pivot shaft 18 and the fixed rocker shaft 24. However, it is often a greater priority to minimize the height of the valvetrain, in which case the spring 28 may be moved from this optimum position.

Figure 2:
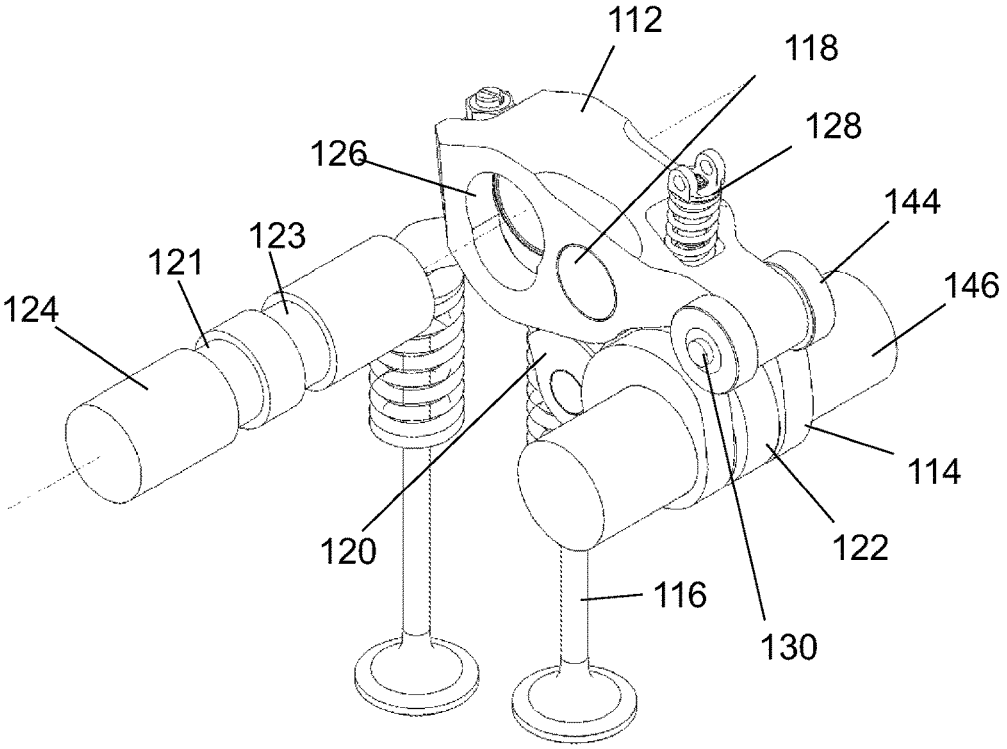
FIG. 2 is an isometric view of a second embodiment of the variable valve lift system, wherein a hole in the first rocker and the rocker shaft passing through the hole with clearance each have more than one diameter.

In a second embodiment of the invention as shown in FIG. 2, the rocker shaft 124 has reduced diameters 121 and 123 in regions where it passes through the first rocker 112. The regions 121,123 of reduced diameter of the rocker shaft 124 allow at least part of the cut-out 126 in the first rocker 112 to be of a reduced diameter, allowing the first rocker 112 to benefit from increased stiffness characteristics due to less material being removed.

It would equally be possible to form the reduced regions of the rocker shaft 124 with one or more slots rather than a reduced diameter in order to reduce the size of the cut-out 126 in the first rocker 112.

If formed as a hole, a portion of the cut-out 126 should remain of a diameter to provide a clearance fit for the larger diameter regions of the rocker shaft 124. The diameter of the rocker shaft 124 is usually specified for a journal bearing of the second rocker 120 and so cannot be directly modified in the region that passes through the second rocker 120. The position of this larger diameter portion of the hole may be positioned anywhere along its swept range in order to maximize stiffness.

The first rocker 212 of FIGS. 3*a* and 3*b* may be formed from sheet metal. Any holes required, such as those for the rocker shaft, the pivot shaft and a cam follower shaft may be stamped or cut out while the material is still in its unfolded sheet state, with the outer profile of the rocker then stamped or cut out, and then finally folded to form the rocker 212. Using sheet metal automatically creates a pocket in which the second rocker may be positioned, avoiding the need for machining operations.

Figure 4:
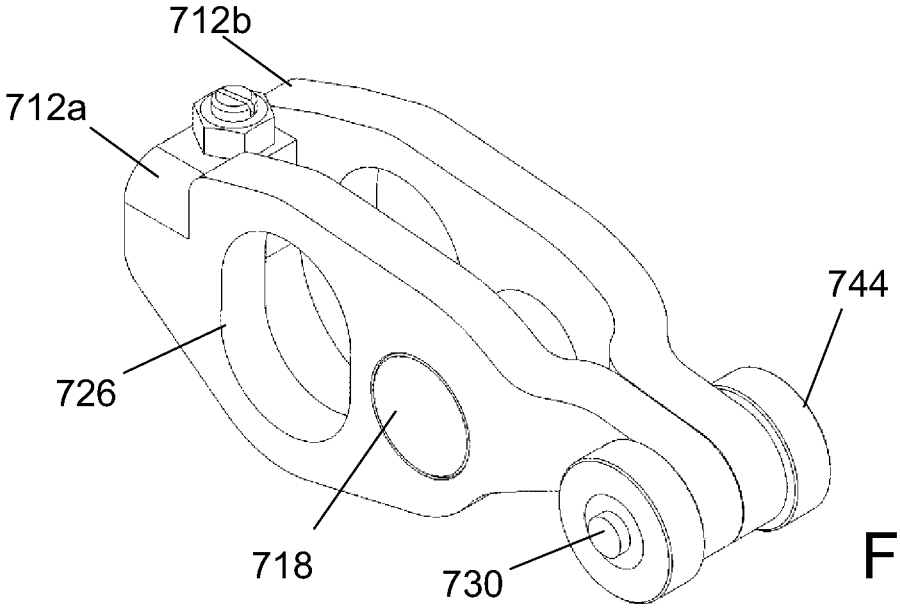
FIG. 4 is an isometric view of an alternative first rocker which is made from two sheet metal parts and assembled using a pivot shaft and a cam follower shaft.

Alternatively, as illustrated in FIG. 4, the first rocker 712 may be assembled from two formed sheet metal parts 712*a* and 712*b*. The two parts may be held together by the pivot shaft 718 and the cam follower shaft 730. Production of the cut-out 726 for the rocker shaft 724 and the pocket for the second rocker may again take place before any forming. It should be noted that the first rocker may be assembled from more than two parts, and it is not essential that all parts be formed of sheet metal.

Figure 5:
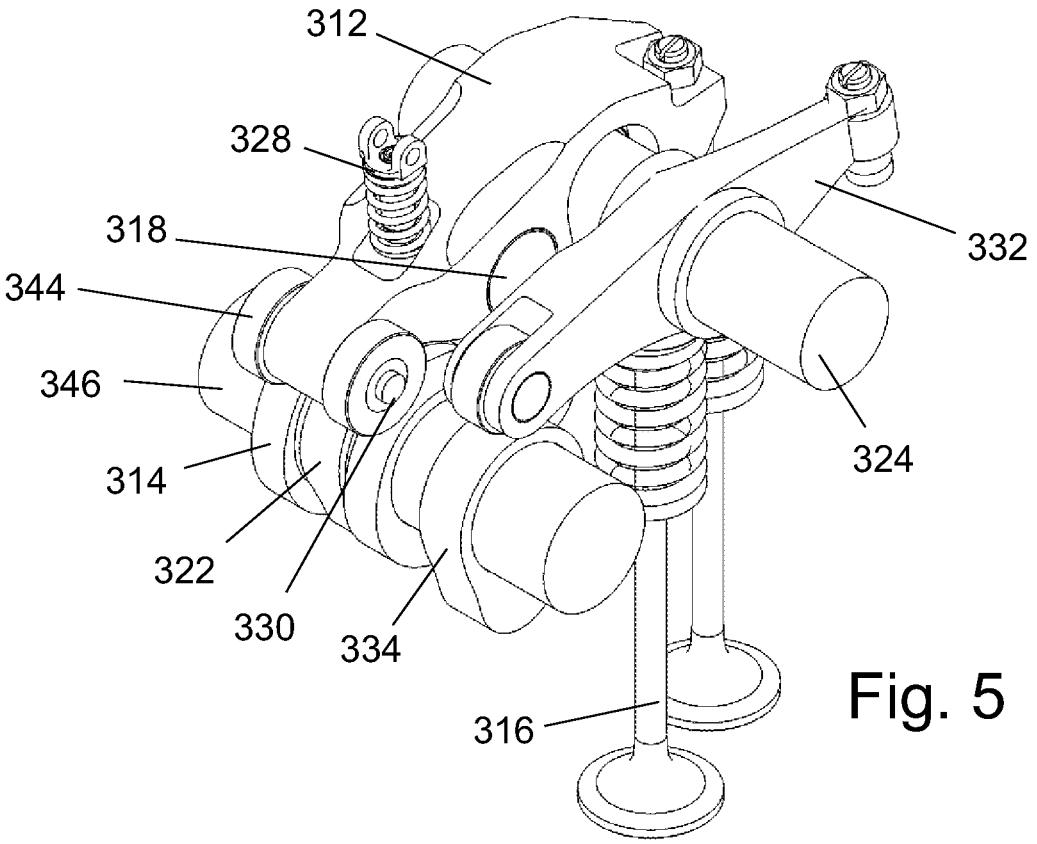
FIG. 5 is an isometric view of a valvetrain, wherein one of the intake and exhaust valve is operated using a cam summation system while the other valve is operated by a conventional rocker and a single cam profile.

It is common for a summation rocker system to be used on only one of the intake or exhaust valves, the valve being operated using a conventional system with a single cam profile. Such a valvetrain is shown in each of FIGS. 5 to 7. In the embodiment of FIG. 5, a conventional third rocker 332 is used to operate a valve not shown in the drawing, the rocker 332 acting between the other valve and a third cam lobe 334 mounted to the camshaft 346. This valve is opened and closed by the third rocker 332 in dependence of a single third cam profile. The rocker 332 pivots about the rocker shaft 324 as shown in FIG. 5. While such a configuration minimises the impact of the summation rocker system on the cylinder head design, the rocker shaft 324 may not provide an optimal position for the pivot of the third rocker 332.

Figure 6:
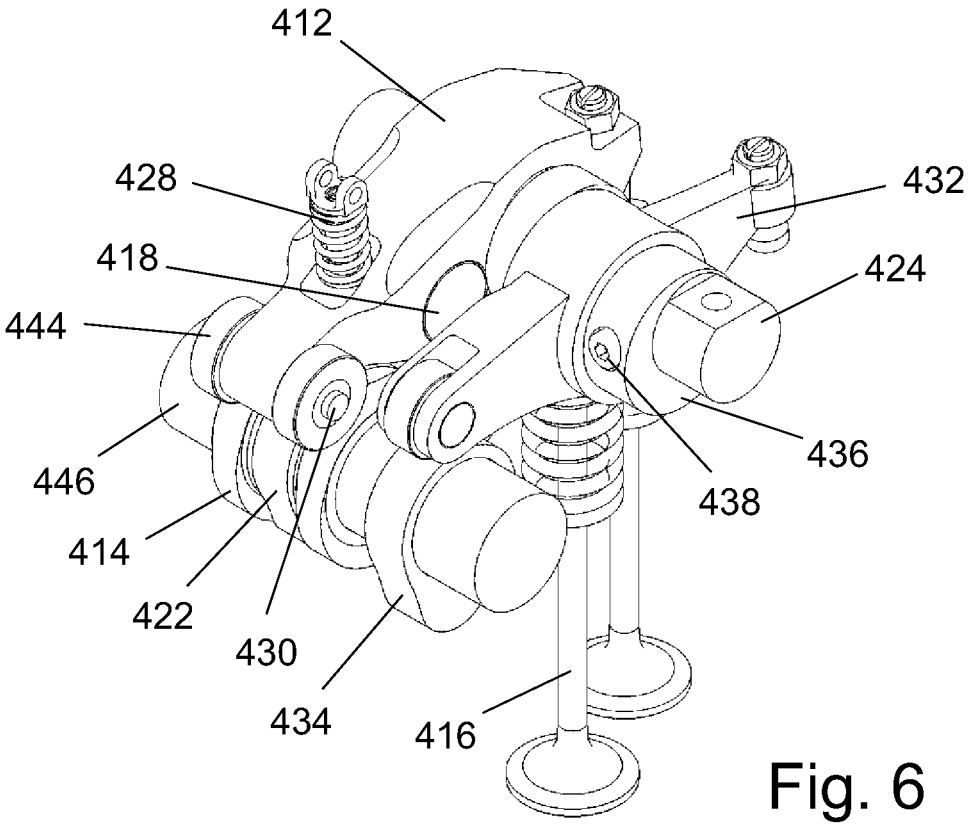
FIG. 6 is an isometric view of a valvetrain similar to that of FIG. 5, but in which an eccentric bushing is used to optimise the position of the pivot axis of the conventional rocker.
Figure 7:
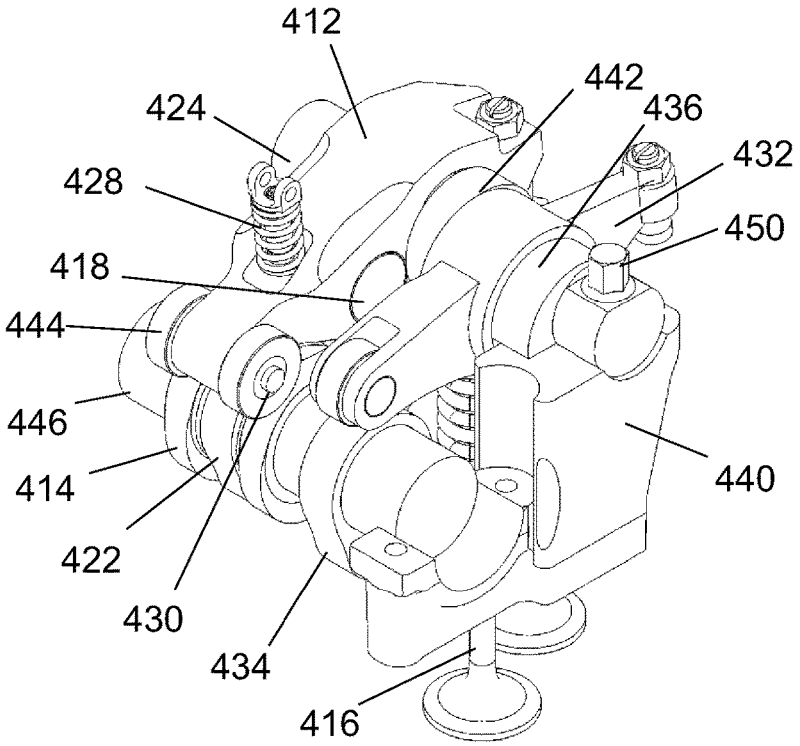
FIG. 7 is an isometric view of a valvetrain similar to that of FIG. 6 showing an alternative way of retaining the eccentric bushing.

The embodiments of the invention shown in FIGS. 6 and 7, provide a solution to mitigate this problem. The position of the pivot axis of the rocker shaft 424 in these embodiments is modified by fitting eccentric components such as bushes 436 to the rocker shaft 424, the third rocker 432 being mounted to the eccentric bush 436. The bushing 436 must be prevented from rotating on the rocker shaft 424. FIG. 6 illustrates the bushing being fixed to the rocker shaft 424 by a machine screw 438. Alternative fixtures may be used.

An alternative approach for preventing rotation of the bushing 436 is adopted in the embodiment illustrated in FIG. 7. Rotation and axial movement in a first direction are constrained by a rocker shaft support 440 with a shaft mounting bolt 450 fixing the rocker shaft 424 to the support 440. Axial movement in the second direction is constrained by a bushing retaining washer 442, and ultimately the first rocker 412 of the summation rocker system. This solution removes the need for any extra fixings and only requires minimal design changes to the rocker shaft support 440 to accept the bushing 436.

As previously disclosed, the control spring 28 can sometimes be mounted in a less than optimal orientation in order to minimize the overall height of the valvetrain. Moving the control spring 28 from its optimal position requires the spring 28 to produce a higher force. Designing a control spring which exerts sufficient force but still fits into the packaging space of the cylinder head may be difficult or costly.

Figure 8:
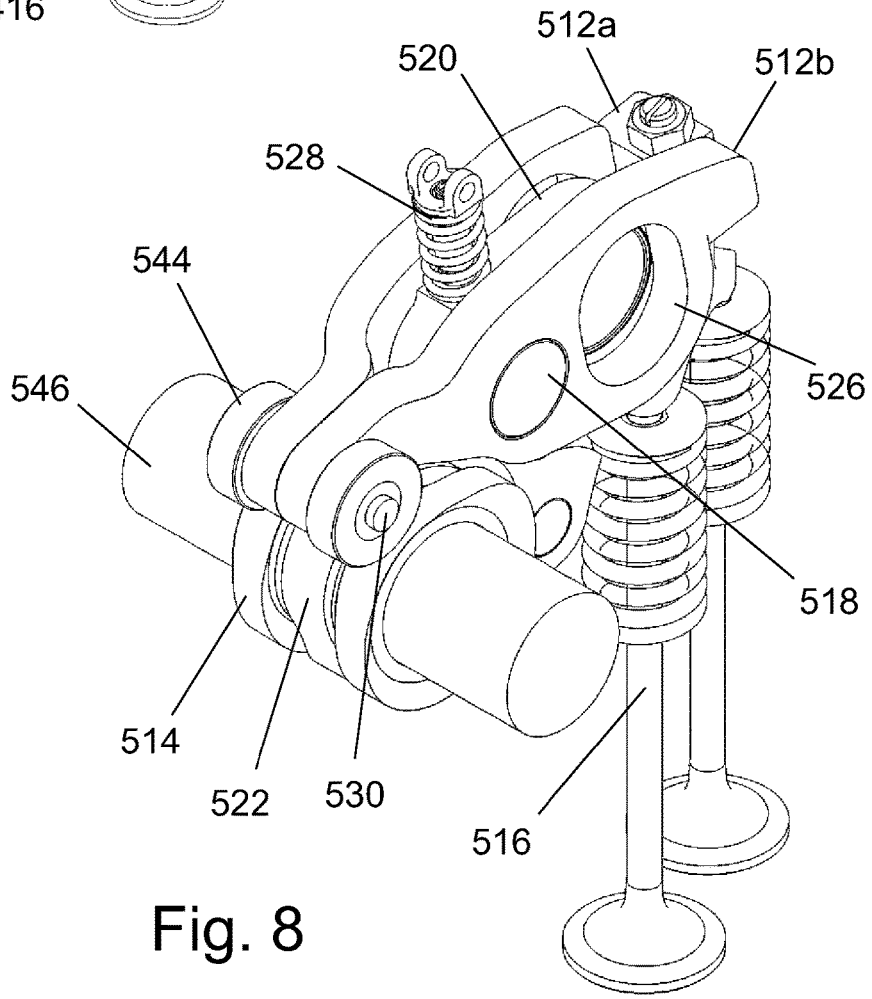
FIG. 8 is a view of a further valvetrain similar to that of FIG. 7 but in which a control spring is mounted on the second rocker rather than the first rocker.

FIG. 8 illustrates an alternative arrangement for the control spring 528. Using the two-piece formed rocker described in the embodiment of FIG. 4, the control spring 528 can be directly mounted to the second rocker 520 instead of the first rocker 512. As the second rocker 520 is mounted lower than the first, mounting the control spring 528 to the second rocker 520 reduces the valvetrain height whilst maintaining an optimal or near optimal angle of the control spring 528. In this position the force vector created by the control spring 528 acts through the pivot shaft 518 perpendicular to the line created between the pivot shaft 518 and fixed rocker shaft 24. The spring 528 is therefore required to produce less force and is easier to package.

It will be appreciated that the embodiments described above may be combined where technically possible. For example, the control spring may act on the second rocker independent of the design of the first rocker. If the first rocker were to be constructed in any other way than illustrated in FIG. 8, then the first rocker may require a through hole for the control spring to pass through. Alternatively, the control spring may be seated in an indent or hole in the first rocker.

Furthermore, it is alternatively possible for the control spring to be arranged to act between the two rockers in order to maintain the desired contact with one of the cam profiles, rather than acting between one of the rockers and a fixed point on the engine.

Although the summation rocker system is, in the above embodiments, related to varying the lift of the valve, the duration that the valves are open and the timing of the valves may be varied depending on the phase of the cam lobes with respect to either each other, the crankshaft of the engine, or both.

The invention may be used with any number of intake or exhaust valves in the engine, or indeed any engine configuration or number of cylinders. Where more than one valve per rocker is acted upon, the valves may be synchronized through a valve bridge connecting them to the rocker.

The invention claimed is:

1. A summation rocker system for acting on a valve stem end of a poppet valve (16) based on combined lifts of a first and a second cam profile respectively defined by different cam lobes (14, 22) of a concentric camshaft (46), the summation rocker system comprising:

a first rocker (12) mounted on a pivot shaft (18), the first rocker including:

a first end configured to contact the first cam profile via a first follower (44); and a second end configured to displace the valve (16) by a lift amount determined by the first cam profile;

a rocker shaft (24) fixedly mounted on an engine; and a second rocker (20) pivotably mounted on the rocker shaft (24), the second rocker (20) configured to contact the second cam profile via a second follower (48) so as to displace the pivot shat (18) by a lift amount determined by the second cam profile, wherein the rocker shaft (24) extends parallel to the pivot shaft (18), and wherein the first rocker (12) further includes a cut-out (26) configured to receive the rocker shaft (24), the cut-out (26) configured to prevent the rocker shaft (24) from interfering with a movement of the first rocker (12).

2. The summation rocker system as claimed in claim 1, wherein the cut-out (26) is a hole configured to permit the rocker shaft (24) to pass through the hole with swept clearance.

3. The summation rocker system as claimed in claim 1, wherein the rocker shaft (124) has a reduced cross sectional area in regions (121,123) where the rocker shaft is received within the cut-out (126).

4. The summation rocker system as claimed in claim 1, wherein the first rocker (212) further includes two surfaces (213,215) axially straddling the second rocker (20) such that the two surfaces (213,215) define a pocket (217) configured to receive the second rocker (20) with clearance.

5. The summation rocker system as claimed in claim 1, wherein the first rocker (212) comprises at least two parts (712*a*; 712*b*) secured to one another.

6. The summation rocker system as claimed in claim 1, wherein the first rocker (212) is formed from sheet metal.

7. The summation rocker system as claimed in claim 1, further comprising a control spring (28) configured to act between a stationary point in the engine and the first rocker (12) so as to urge the first follower (44) towards the first cam profile (14).

8. The summation rocker system as claimed in claim 1, further comprising a control spring (528) connected to the second rocker (520), the control ring configured to pass with clearance through a hole in the first rocker (512) which extends in a direction perpendicular to the pivot shaft.

9. A valvetrain comprising the summation rocker system of claim 1, wherein the engine includes an intake valve and an exhaust valve, wherein the valve (16) is one of the intake valve or the exhaust valve such that said summation rocker system is configured to open and close the one of the intake valve or the exhaust valve, and wherein the valvetrain further comprises a third rocker (332) configured to operate a remaining one of the intake valve or the exhaust valve based on a single profile of a third cam (334) of the camshaft.

10. The valvetrain as claimed in claim 9, wherein the third rocker (332) is pivotably mounted about an axis of the rocker shaft (324).

11. The valvetrain as claimed in claim 9, wherein the third rocker (432) is mounted to the rocker shaft (424) via an eccentric component (436) so as to pivot about an axis offset from an as is of the second rocker (420).

* * * * *